US005237718A

United States Patent [19]

Brown

[11] Patent Number: 5,237,718

[45] Date of Patent: Aug. 24, 1993

[54] SOOTBLOWER WITH LANCE BYPASS FLOW

[75] Inventor: Clinton A. Brown, Baltimore, Ohio

[73] Assignee: The Babcock & Wilcox Company, New Orleans, La.

[21] Appl. No.: 877,641

[22] Filed: May 1, 1992

[51] Int. Cl.[5] ..... F23J 3/00

[52] U.S. Cl. ..... 15/318.1; 122/390

[58] Field of Search ..... 15/316.1, 318, 317, 15/318.1; 122/390, 392

[56] References Cited

U.S. PATENT DOCUMENTS 4,380,843 4/1983 Sullivan et al. ..... 15/316.1

4,905,900 3/1990 Scharton et al. ..... 15/316.1 X 5,063,632 11/1991 Clark et al. ..... 15/316.1

*Primary Examiner*—Chris K. Moore

*Attorney, Agent, or Firm*—Harness, Dickey & Pierce

[57] ABSTRACT

A sootblower for use in cleaning heat exchanger surfaces in which a drain is provided for selectively draining a portion of the blowing medium from the sootblower lance tube for discarding externally of the heat exchanger. The lance tube drain enables the discharge of blowing medium from the lance tube into the heat exchanger to be reduced during portions of a cleaning cycle in which the lance tube nozzles are not directed toward a surface to be cleaned yet enabling a minimum flow of blowing medium through the lance tube for cooling or other purposes without discharging the minimum flow of blow medium into the heat exchanger.

15 Claims, 1 Drawing Sheet

SOOTBLOWER WITH LANCE BYPASS FLOW

BACKGROUND AND SUMMARY OF THE INVENTION

This invention relates generally to a sootblower device for directing a fluid spray against a heat exchanger surface for cleaning the heat exchanger surface and in particular to a sootblower device having a drain for return of a portion of the fluid medium from the lance tube which is selectively controllable to regulate the flow of the fluid against the heat exchanger surface.

Cleaning highly heated surfaces, such as the surfaces of a boiler, furnace, incinerators or the like used to extract heat, has commonly been performed by devices generally known as sootblowers. Sootblowers typically employ water, steam, air or a combination thereof as a blowing medium which is directed through one or more nozzles against encrustations of slag, ash, scale and/or other foul materials which become deposited on the heat exchanger surfaces. Throughout the specification claims, the term "heat exchanger" is broadly used to refer to boilers, furnaces, incinerators or the like having internal surfaces in need of periodic cleaning to remove encrustations.

It is known that water in liquid form, either used alone or in combination with a gaseous blowing medium, increases the ease with which the encrustations are dislodged. The effectiveness of water in dislodging the encrustations results from a thermal shock effect coupled with mechanical impact. The thermal shock shrinks and embrittles the encrustations resulting in a fracturing of the encrustations so that they become dislodged and fall away from the heat exchanger surfaces because of the mechanical impact.

Various types of sootblowers have been developed for cleaning heat exchanger surfaces One type of sootblower is known as the retracting variety which employs a lance tube that is advanced into a heat exchange through a wall port. The lance tube has one or more nozzles through which the cleaning or blowing medium is discharged and sprayed against the heat exchanger surfaces. After a cleaning cycle has been completed the lance tube is retracted from the heat exchange until cleaning is again needed. During each cleaning cycle, in addition to being advanced and retracted into and from the boiler, the lance tube is often rotated so that the spray of blowing medium is directed along a spiral path against the heat exchanger surfaces. Retractable sootblowers are used in applications where the internal temperatures of the heat exchanger are sufficient to damage the lance tube and shorten its life if permanently installed in the heat exchanger. Other sootblowers employ a permanently positioned lance tubes which, during each cleaning cycle may be rotated or rotationally oscillated back and forth to move the jet stream of the blowing medium.

Unfortunately, to obtain sufficient cleaning with the water spray process mentioned above, a danger of over stressing the hot heat exchanger surfaces is present. Rapid deterioration of the heat exchanger surfaces as a result of thermal shock from the cleaning process has been observed. The problem of heat exchanger surface deterioration has been particularly severe in connection with cleaning the rigidly held tube bundles of large scale boilers. Being rigidly held, the tubes can not readily distort in response to the temperature induced shrinkage and expansion occurring during a cleaning cycle. The potential for damage to the heat exchanger surfaces is greater if the blowing medium is sprayed against a surface a second time, after it has been recently cleaned, where the blowing medium contacts the surface directly rather than contacting an encrustation on the surface. Such multiple cleanings of a surface can occur where the jet stream from two sootblowers overlap one another. As a result, it is desirable to periodically, during a cleaning cycle, terminate the flow of the blow medium from the sootblower where the jet stream will cover a previously cleaned surface.

During certain portions of the lance tube rotation during a cleaning cycle, the jet stream will not be directed toward a heat exchanger surface in need of cleaning. It is also desirable to stop the flow of the blowing medium to avoid the needless discharge into the heat exchanger which places a thermal load on the heat exchanger and also wastes the blowing medium.

However, in terminating or reducing the flow of the blowing medium, it is not always possible or practical to entirely eliminate the flow of the blowing medium. For example, it may be necessary to maintain a minimum flow rate through the lance tube in order to provide cooling of the lance tube within the heat exchanger.

Accordingly, it is an object of the present invention to provide a means for regulating the flow of the blowing medium from the lance tube into the heat exchanger during each cleaning cycle depending on the position of the lance tube nozzles.

It is a feature of the present invention to provide the sootblower with a drain for returning a portion of the blowing medium from the lance tube for disposal outside of the heat exchanger so that excess blowing medium is not discharged into the heat exchange. This returned cleaning medium can be reused or discarded.

In one embodiment of the invention, the lance tube is equipped with an inner tube extending therein creating an inner passage within the inner tube and an outer passage between the inner tube and the inner surface of the lance tube. The outer passage is used for supplying the blowing medium to the lance tube while the inner passage is used for return of a portion of the blowing medium for discarding externally of the heat exchanger. By opening the return flow path, the flow of the blowing medium through the lance tube nozzles is controllable based on the relative restriction to flow of the blowing medium through the nozzle as compared to the return flow path. When it is desirable to terminate or at least reduce the flow of the blowing medium through the lance tube nozzles, the supply of blowing medium can be reduced to a minimum value necessary for cooling and other purposes. However, to further reduce the discharge of blowing medium through the nozzle, the return flow path is open whereby only a portion of the blowing medium used for cooling, etc. is discharged through the nozzles and into the heat exchanger. The remainder is discarded externally of the heat exchanger.

Further objects, features and advantages of the invention will become apparent from a consideration of the following description and the appended claims when taken in connection with the accompanying drawings.

DETAILED DESCRIPTION OF THE INVENTION

Figure 1:
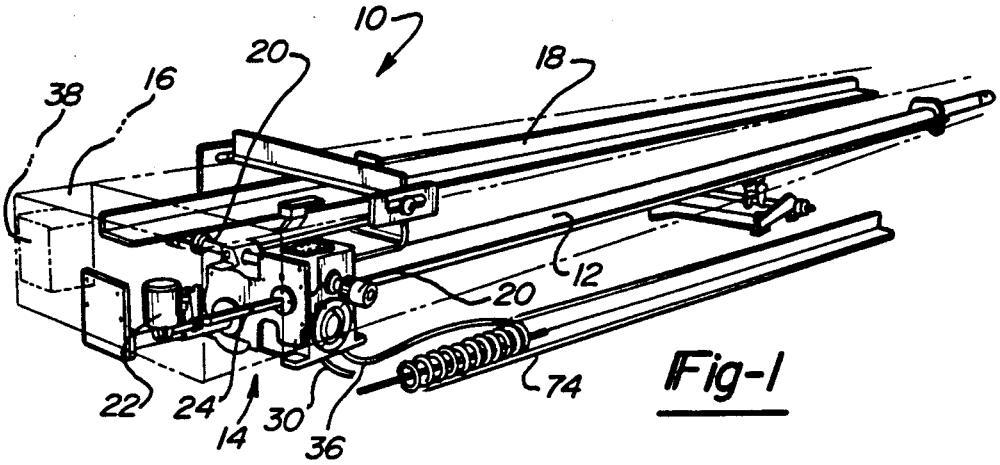
FIG. 1 is a perspective view of a retractable sootblower including the fluid drain from the lance tube of the present invention.

Referring now to the drawings, a sootblower of the present invention is shown having a fluid bypass from the lance tube for use in regulating the flow of the blowing fluid through the lance tube nozzles. A sootblower of the long retracting variety incorporating the features of the present invention is shown in FIG. 1 and designated generally at 10. Sootblower 10 is generally of the type described in a copending U.S. Patent Application filed concurrently with this application entitled "METHOD AND APPARATUS FOR CONSTANT PROGRESSION OF A CLEANING JET ACROSS HEATED SURFACES", and in U.S. Pat. No. 3,439,376 both assigned to the Assignee of this invention and hereby incorporated by reference. Sootblowers of the general variety shown in FIG. 1 are well known within the art. As will become more apparent from the discussion which follows, the principals of the present invention will have applicability to sootblowers in general and are not limited to sootblowers of the retracting variety.

A lance tube 12 is mounted to a carriage assembly 14 and is reciprocally inserted into a heat exchanger to clean surfaces by discharging the blowing medium in a jet stream against the surfaces. The carriage assembly is supported by a frame box 16 which is in turn mounted to a wall box (not shown) of the heat exchanger. The frame box 16 forms a protective housing for the sootblower 10 exteriorly of the heat exchanger. To permit translational motion of the lance tube 12, the carriage assembly 14 travels on rollers (not shown) along a pair of tracks 18 (only one of which is shown) which are rigidly connected to the frame box 16. The tracks 18 include toothed racks which are engaged by pinion gears 20 of the carriage assembly drive train to induce translation of the carriage. A motor 22 is mounted to the frame box and rotates a drive shaft 24 which extends the substantial length of the frame box 16 and passes through the carriage assembly 14. A drive train within the carriage assembly is slidably coupled to the drive shaft 24 so that the carriage assembly is capable of translational movement along the length of the drive shaft. The drive train rotates the pinion gears 20 causing the carriage assembly to translate along the tracks 18 and thereby advance and retract the lance 12 from the heat exchanger depending upon the direction of rotation of the drive shaft 24. In addition, the drive train is also operable to rotate the lance 12 about its longitudinal axis.

A flexible supply hose 30 extends into the bottom of the carriage assembly 14 and supplies the blowing medium to the lance tube 12. A cable carrier 74 is preferably employed to support the length of supply hose 30 necessary to provide for travel of the carriage assembly along the length of the frame box 16. A flexible return hose 36 is coupled to the bottom of the carriage assembly for return of a portion of the blowing medium from the lance tube 12. Return hose 36 is likewise carried by the cable carrier 74 along with the supply hose 30.

A programmable controller 38, which may be a common microprocessor, is coupled to position encoders which provide information to the controller regarding the translational and rotational position of the lance tube 12. The controller 38 is programmed for the specific configuration of the heat exchanger surfaces to be cleaned. Controller 38 is operable to control the supply flow of the cleaning medium as well as the return flow to regulate the discharge of the cleaning medium from the lance tube into the heat exchanger.

Figure 2:
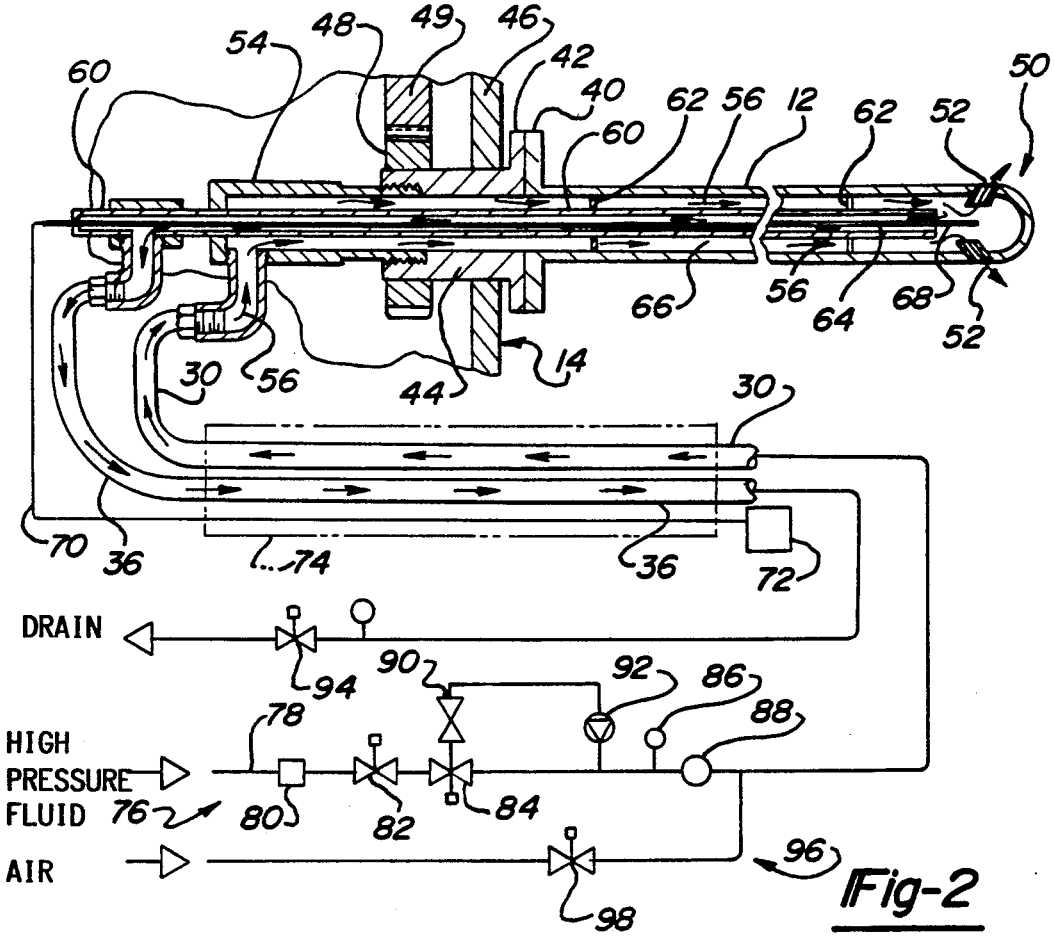
FIG. 2 is a schematic diagram showing the blowing fluid supply to the lance tube and fluid drain according to the present invention.

With reference to FIG. 2, the lance tube fluid supply and fluid return systems are shown in greater detail. Lance tube 12 includes a radial flange 40 at its proximal end coupled to the flange 42 of a lance tube hub 44. The lance tube hub 44 extends through the wall 46 of the carriage assembly and is rotationally driven by spur gears 48 and 49 of the carriage assembly drive train. The lance tube includes at the distal end 50 a pair of nozzles 52 through which jet streams of the blowing medium are discharged from the lance tube 12 for impingement against the heat exchanger surfaces. The inlet supply hose 30 is coupled to the lance tube 12 through a rotary union 54 to supply cleaning fluid to the interior of the lance tube as shown by the arrows 56.

An inner tube 60 extends through the lance tube and terminates near the distal end of the lance tube adjacent to the nozzles 52. The inner tube is supported within the lance tube by a plurality of spacers 62 which provide for fluid flow past the spacers. The inner tube extends axially beyond the rotary union 54 and proximal end of the lance tube where it is coupled to the flexible return hose 36. The inner tube 60 thus divides the interior of the lance tube into two passages, an inner passage 64 within the inner tube and an outer passage 66 between the inner tube and the interior wall of the lance tube. In the embodiment disclosed, the outer passage is used to supply the blowing medium to the nozzles at the end of the lance tube while the inner passage is used to return a portion of the cooling medium from the lance tube for subsequent discharge outside of the heat exchanger. However, it is to be understood that the flow direction can be reversed with the fluid supply flowing through the inner passage with the return flow in the outer passage. The distal end of the inner tube is open so that the inner and outer passages are in communication with one another within the lance tube. In the embodiment shown, where the nozzles are at the distal end of the lance tube, it is preferable for the inner tube to extend to the distal end of the lance tube whereby the inner and outer flow passages are in communication with one another adjacent to the nozzles so that the supply flow of the blowing medium extends the substantial length of the lance tube before entering the return flow passage of the inner tube 60. If desired, a temperature probe 68 can be placed adjacent to the nozzles in the lance tube with a temperature probe signal wire 70 extending through the inner tube to a signal processor 72.

The supply hose 30, return hose 36 and signal wire 70 are all carried by the cable carrier 74 which carries sufficient lengths of the hoses and wire to accommodate the translation of the carriage assembly along the frame box 16. The supply of blowing medium to the hose 30 is controlled by a flow control system 76. The control system 76 receives a high pressure blowing fluid through inlet 78 which can come from any of a variety of sources including a high pressure pump, plant high pressure fluid supply etc. The incoming fluid is first passed through a strainer 80 to remove particulate contamination. A solenoid valve 82 is used to open and close the system to initiate and terminate the flow of cleaning fluid at the beginning and end of each cleaning cycle.

A three-way solenoid valve 84 is used to switch between low and high pressure as described further below. In its unenergized state, the high pressure side is open, supplying the blowing medium which then passes pressure gauge 86 and pressure switch 88. During periods when the nozzles 52 are directed toward surfaces which need to be clean, high pressure fluid flow is needed.

However, when the nozzles are not directed toward surfaces needing cleaning, it is wasteful and potentially damaging to the heat exchanger for continued discharge of cleaning fluid into the boiler. When cleaning is not needed, the three-way valve 84 is energized, whereby the cleaning fluid is diverted through the low pressure side of the control system which includes a reducing valve 90 and a check valve 92. This provides a lower pressure and lower flow rate of the blowing medium to the lance tube for cooling the lance tube. The lower volume flow rate of the blowing medium is sufficient for cooling of the lance tube.

To avoid the undesirable thermal load on the heat exchanger if the cooling flow of the blowing medium is discharged into the heat exchanger, the return hose 36 and inner tube 60 are used to drain a portion of the blowing medium from the lance tube for discharge outside of the heat exchanger. When the valve 84 is energized to reduce the flow rate of the blowing medium, the drain valve 94 is opened allowing flow through the inner tube and return hose 36. The inner tube and return hose provide a parallel flow path for the blowing medium. The relative flow restrictions through the nozzle and the drain will determine the proportion of the blowing medium which is discharged through the nozzles and the portion which is drained from the lance tube. Preferably, the drain has a minimum flow restriction so that a majority of the blowing medium is drained from the lance tube rather than being discharged through the nozzles 52. The flow bypass or drain allows a flow of the blowing medium through the lance tube for cooling or other purposes while avoiding excess discharge of blowing medium into the heat exchanger.

An air inlet 96 is provided and coupled to the supply hose 30 for use in purging water from the lance tube to prevent unwanted dripping of the blowing fluid from the nozzles when the sootblower is not in use. This is necessary for a retractable type sootblower in which, when not in use, the lance tube is positioned externally of the heat exchanger. A solenoid valve 98 is provided to open and close the air inlet. As the sootblower lance tube is retracted to its nonuse position outside of the heat exchanger, the valve 98 is opened as the valve 82 is closed, introducing air into the supply hose 30 to blow the remaining cleaning fluid from the lance tube.

The sootblower of the present invention thus regulates the flow of the blowing medium from the lance tube into the heat exchanger by providing a return flow path for draining a portion of the blowing medium from the lance tube. The relative restrictions to fluid flow through the drain and the nozzles will determine the proportion of flowing medium being drained and being discharged into he heat exchanger. The sootblower of the present invention enables the discharge of blowing medium into the heat exchanger to be significantly reduced during periods of a cleaning cycle in which the nozzles are not directed toward surfaces to be cleaned, while at the same time enabling a flow create of blowing medium through the lance tube sufficient for cooling purposes yet not discharging that entire flow into the heat exchanger but rather draining a portion of that from the lance tube and heat exchanger.

It is to be understood that the invention is not limited to the exact construction illustrated and described above, but that various changes and modifications may be made without departing from the spirit and scope of the invention as defined in the following claims.

I claim:

1. A sootblower for cleaning surfaces within a heat exchanger comprising:

a hollow lance tube having distal and proximal ends;

at least one discharge nozzle affixed to said lance tube and communicating with the interior of said lance tube;

means in communication with the proximal end of said lance tube for supplying a pressurized blowing medium to the interior of said lance tube for discharge through said at least one nozzle and for impingement upon the heat exchanger surfaces;

drain means for creating a return flow path for said blowing medium from said lance tube and for disposing of a return flow of said blowing medium externally of said heat exchanger; and means for controlling the flow of said blowing medium through said at least one nozzle and said return flow path whereby during operation of said sootblower the flow of blowing medium through said at least one nozzle can be varied between a high flow rate for cleaning and a reduced flow rate when said at least one nozzle is not directed toward a surface to be cleaned.

2. The sootblower of claim 1 wherein said supplying means includes means for regulating the flow of blowing medium into said lance tube.

3. The sootblower of claim 1 wherein said drain means includes an inner tube extending within said lance tube over a portion of the length of said lance tube forming an inner flow passage within said inner tube and an outer flow passage between said inner tube and said lance tube, said supplying means using one of said inner or outer passages for supplying said blowing medium to said lance tube and said return means using the other of said inner or outer passages for returning said blowing medium from said lance tube for disposal externally of said heat exchanger.

4. The sootblower of claim 3 wherein:

said drain means includes a valve means in said return flow path for selectively opening and closing said return flow path.

5. The sootblower of claim 3 wherein said inner tube extends substantially the entire length of said lance tube.

6. The sootblower of claim 3 wherein said inner passage is used to supply said blowing medium and said outer passage is used as said return flow path for said blowing medium.

7. A sootblower for cleaning surfaces within a heat exchanger comprising:

a hollow lance tube having distal and proximal ends;

at least one discharge nozzle affixed to said lance tube and communicating with the interior of said lance tube;

supplying means in communication with the proximal end of said lance tube for supplying a pressurized blowing medium to the interior of said lance tube for discharge through said nozzle and for impingement upon the surfaces of said heat exchanger, said supplying means operable to selectively supply said blowing medium at a high cleaning flow rate for cleaning said surfaces or a relatively low cooling flow rate for cooling said lance tube;

means for moving said nozzle along a predetermined path of travel, said nozzle being directed toward the heat exchanger surfaces during one or more portions of said path of travel during which it is desirable for supplying said means to supply said blowing medium at said cleaning flow rate and ruing the remainder of said path of travel it is desirable for said supplying means to supply said blowing medium at said cooling flow rate to cool said lance tube; and drain means for selectively creating a return flow path for at least a portion of said blowing medium from said lance tube during said remainder of said nozzle path of travel when said cooling flow rate is desired and for disposing of a return flow of said blowing medium externally of said boiler, whereby only a remainder of said blowing medium is discharged through said nozzle.

8. The sootblower of claim 7 wherein said means for moving includes means for rotating said lance tube.

9. The sootblower of claim 7 wherein said means for moving Includes means for advancing and retracting said lance tube into and from said heat exchanger.

10. The sootblower of claim 7 wherein said means for moving includes means for rotating said lance tube and for advancing and retracting said lance tube into and from said heat exchanger.

11. A sootblower for cleaning surfaces within a heat exchanger comprising:

a hollow lance tube having distal and proximal ends;

at least one discharge nozzle affixed to said lance tube and communicating with the interior of said lance tube;

an inner tube within a portion of said lance tube and extending out of said lance tube from the proximal end of said lance tube, said inner tube forming within said lance tube an inner passage within said inner tube and an outer passage between sad inner tube and said lance tube, said inner tube having an open distal end within said lance tube whereby said inner and outer passage communicate with one another;

supplying means in communication with the proximal end of said lance tube for supplying a pressurized blowing medium through one of said inner or outer passages for discharge through said nozzle and for impingement upon surfaces of said heat exchanger, said supplying means selectively supplying said blowing medium at a first high pressure for cleaning said surfaces and at a second low pressure when not cleaning said surfaces; and drain means for selectively creating a return flow path for said blowing medium from said lance tube through the other of said inner or outer passages and for disposing of a return flow of said blowing medium externally of said heat exchanger when not cleaning said surfaces whereby only a portion of the blowing medium supplied to said lance tube is discharged through said nozzle.

12. The sootblower of claim 11 wherein said blowing medium is supplied to said lance tube through said outer passage and said drain means creates a return flow path for said blowing medium through said inner passage.

13. The sootblower of claim 11 further comprising means for rotating said lance tube about the longitudinal axis of said lance tube and wherein said supplying means is coupled to the proximal end of said lance tube through a rotary union.

14. The sootblower of claim 13 further comprising means for advancing said lance tube into said heat exchanger for cleaning said surfaces of said heat exchanger and for retracting said lance tube from said heat exchanger during times of nonuse of said sootblower.

15. The sootblower of claim 14 wherein said nozzle is directed toward said surfaces during a portion of the operation of said sootblower during which said supply means supplies said blowing medium at said first high pressure and, said nozzles are directed toward surfaces not to be cleaned during a remaining portion of the operation of said sootblower during which said supply means supplies said blowing medium at said second low pressure and said drain means is operated to create said return flow path for draining a portion of said blowing medium from said lance tube.

* * * * *

UNITED STATES PATENT AND TRADEMARK OFFICE

CERTIFICATE OF CORRECTION

PATENT NO. : 5,237,718
DATED : August 24, 1993
INVENTOR(S) : Clinton A. Brown

It is certified that error appears in the above-indentified patent and that said Letters Patent is hereby corrected as shown below:

Column 7, Line 9, Claim 7, before "the" delete "ruing" and insert --during--.

Column 7, Line 24, Claim 9, after "moving" delete "Includes" and insert --includes--.

Signed and Sealed this

Twelfth Day of April, 1994

Bruce Lehman

*Attest:*

BRUCE LEHMAN

*Attesting Officer*

*Commissioner of Patents and Trademarks*